US007707714B2

(12) United States Patent
Schmidt et al.

(10) Patent No.: US 7,707,714 B2
(45) Date of Patent: May 4, 2010

(54) METHOD FOR PRODUCING A MICROCOIL

(75) Inventors: Oliver G. Schmidt, Stuttgart (DE); Christoph Deneke, Stuttgart (DE)

(73) Assignee: Max-Planck Gesellschaft zur Forderung der Wissenschaften E.V., Munich (DE)

( * ) Notice: Subject to any disclaimer, the term of this patent is extended or adjusted under 35 U.S.C. 154(b) by 251 days.

(21) Appl. No.: 10/498,278

(22) PCT Filed: Nov. 12, 2002

(86) PCT No.: PCT/DE02/04180

§ 371 (c)(1),
(2), (4) Date: Feb. 1, 2005

(87) PCT Pub. No.: WO03/048032

PCT Pub. Date: Jun. 12, 2003

(65) Prior Publication Data

US 2005/0118733 A1 Jun. 2, 2005

(30) Foreign Application Priority Data

Dec. 4, 2001 (DE) ..... 101 59 415

(51) Int. Cl.
*H01R 9/00* (2006.01)

(52) U.S. Cl. ..... 29/842; 29/846; 29/884; 29/874; 29/605; 336/200; 438/381

(58) Field of Classification Search ..... 29/874, 29/884–885, 882, 876–877, 825, 846, 602.1, 29/605–606; 336/200, 232, 223; 439/81, 439/591; 430/320–322; 428/615–618; 438/329, 438/381, 957

See application file for complete search history.

(56) References Cited

U.S. PATENT DOCUMENTS

| | | | | | |
|---|---|---|---|---|---|
| 5,367,136 | A | * | 11/1994 | Buck | 200/600 |
| 5,665,648 | A | * | 9/1997 | Little | 438/117 |
| 5,914,218 | A | * | 6/1999 | Smith et al. | 430/320 |
| 5,979,892 | A | * | 11/1999 | Smith | 271/267 |
| 6,127,908 | A | * | 10/2000 | Bozler et al. | 333/246 |
| 6,183,267 | B1 | * | 2/2001 | Marcus et al. | 439/66 |

(Continued)

FOREIGN PATENT DOCUMENTS

DE 196 40 676 A1 10/1997

(Continued)

OTHER PUBLICATIONS

V. Ya.Prinz et al, "Free-standing and overgrown InGaAs/GaAs nanotubes, nanohelices and their arrays", Elsevier Science B.V., Physica E 6 (2000), pp. 828-831.

(Continued)

*Primary Examiner*—Minh Trinh

(57) ABSTRACT

Production of microscopic and nanoscopic coils, by rolling up conductor layers during the removal of auxiliary layers from a substrate. By removing the auxiliary layer from the substrate, for example by virtue of a sacrificial layer situated in between being selectively etched away, the auxiliary layer folds back and, if appropriate, automatically rolls up upon continuation of the removal operation and a conductor track concomitantly rolls up in the process. The auxiliary layer may be formed by two layers having different lattice constants. It is possible to produce microcoils, microtransformers, or microcapacitors constructed from said microcoils, with diameters in the nanometers or micrometers range.

11 Claims, 5 Drawing Sheets

U.S. PATENT DOCUMENTS

| | | | | |
|---|---|---|---|---|
| 6,229,684 | B1 * | 5/2001 | Cowen et al. | 361/278 |
| 6,245,444 | B1 * | 6/2001 | Marcus et al. | 428/616 |
| 6,290,510 | B1 * | 9/2001 | Fork et al. | 439/81 |
| 6,392,524 | B1 * | 5/2002 | Biegelsen et al. | 336/200 |
| 6,582,989 | B2 * | 6/2003 | Biegelsen et al. | 438/106 |
| 6,856,225 | B1 * | 2/2005 | Chua et al. | 336/192 |
| 7,000,315 | B2 * | 2/2006 | Chua et al. | 29/874 |
| 7,517,769 | B2 * | 4/2009 | Van Schuylenbergh et al. | 438/381 |

FOREIGN PATENT DOCUMENTS

| | | |
|---|---|---|
| EP | 0 986 106 A1 | 3/2000 |

OTHER PUBLICATIONS

Oliver G. Schmidt et al., "Thin solid film roll up into nanotubes", Nature, vol. 410, No. 168, Mar. 8, 2001, p. 168.

* cited by examiner

METHOD FOR PRODUCING A MICROCOIL

BACKGROUND OF THE INVENTION.

1. Field of the Invention.

The present invention relates to the field of microtechnology and nanotechnology and the production of integrated electrical components, namely microcoils, microtransformers and microcapacitors on a substrate. In particular, the invention relates to a special method for producing such microscopic and nanoscopic components, which method can be employed on a semiconductor substrate.

2. Description of Related Art.

For radiofrequency applications, it is necessary for coils having suitable inductance and capacitors having suitable capacitance to be integrated on the circuit. The general trend toward miniaturization requires that these devices can be produced as three-dimensional microcoils or microtransformers directly on surfaces of finished processed electronic components. However, the methods known to date lead to relatively space-consuming spirals in the region of the coils, which spirals, moreover, can only be produced in relatively complicated methods.

The published German patent application DE 196 40 676 A1 discloses for example a method for producing microcoils and microtransformers, in which a patternable layer is applied to a conductive start layer and is patterned in order to form a mold for a coil winding and coil winding material is subsequently deposited into the mold. After the mold has been filled, the patternable layer is removed and an insulation layer comprising a plastic film provided with an adhesive layer is applied in a panelizing manner by means of pressure and heat. These steps are repeated in accordance with the number of coil windings arranged one above the other. The microcoils produced in this way typically have diameters of a few μm. A significant miniaturization appears to be realizable only with difficulty by means of this known method. Moreover, this method with its individual method steps is extremely complicated.

In the field of capacitors, too, there is no known method which can be used to fabricate capacitors having nanoscopic dimensions with a tenable outlay.

SUMMARY OF THE INVENTION.

Consequently, it is an object of the present invention to specify a method for producing microcoils, microtransformers and microcapacitors which manages with a relatively small number of method steps. In particular, the intention is for the method to make it possible to produce coils having a coil diameter of less than 1 μm and capacitors having a distance between the capacitor electrodes of likewise less than 1 μm.

This object is achieved by means of the features of the independent patent claims. Advantageous refinements and developments are specified in the subclaims.

In a first aspect, the invention relates to a method for producing a microcoil and a method—based thereon—for producing a microtransformer.

In a second aspect, the invention relates to a method for producing a microcapacitor.

In a third aspect, the invention relates to a microcoil and a microtransformer formed from two microcoils.

In a fourth aspect, the invention relates to a microcapacitor.

The method according to the invention is based on the rolling-up, known per se, of solid layers—also referred to as auxiliary layers hereinafter—during their removal from a substrate, as has been described in the publications "Free-standing and overgrown InGaAs/GaAs nanotubes, nanohelices and their arrays" by V. Ya. Prinz et al. in Physica E & (2000), 828-831, and "Thin solid films roll up into nanotubes" by O. G. Schmidt et al. in Nature 410, 168 (2001).

In the first-mentioned publication, the solid layer comprises a layer pair of the binary semiconductor materials InAs/GaAs which has been deposited in this order with a layer thickness of a few monolayers on an InP substrate with an AlAs sacrificial layer lying in between. After the removal of the layer pair by selective etching of the AlAs sacrificial layer, the InAs layer, which is compressed on account of the lattice mismatch between InAs and GaAs, tends to expand, whereas the stretched GaAs layer tends to contract. These two forces have the effect that the composite layer rolls up in a direction facing away from the substrate. The use of such intrinsically strained solid layers means that hollow cylinders, so-called nanotubes, are produced, the diameter of which can be set between 3 μm and a plurality of μm depending on the thickness of the deposited layers.

The second-mentioned publication shows that this method can be applied successfully to the SiGe material system. Firstly, a Ge sacrificial layer is deposited on an Si substrate. Two layers are then deposited successively on said sacrificial layer, of which the layer deposited first has a larger lattice constant than the layer deposited afterward. Both layers may be constructed from an SiGe mixed crystal, the lower layer having a relative Ge excess and the upper layer having a relative Si excess. It is furthermore shown that sacrificial layer etching times of corresponding length can cause the layer to roll up in a plurality of turns and thus form a spirally wound hollow cylinder. Moreover, it is proposed, inter alia, to roll up metal in said nanotubes in order thus to produce electrical cables.

Moreover, the second-mentioned publication mentions that the method can also be carried out with a single layer ("Method I"), which may likewise have an internal strain, but this need not necessarily be the case, in contrast to the double layer of Method II. In this case, all that takes place is a folding-over of the layer after the removal thereof from the substrate, so that no special requirements have to be made of the auxiliary layer. In principle, it is possible to use any desired auxiliary layer if a sacrificial layer is found which can be selectively etched by means of a suitable selective etching medium below the auxiliary layer.

The method of using a single solid layer as auxiliary layer will be referred to below as Method I and the method of using a double layer as auxiliary layer will be referred to below as Method II.

The method according to the invention in accordance with the first aspect of the invention is based on the essential conceptual furtherance according to which a section of an auxiliary layer applied on a substrate is removed from the substrate in a suitable manner and a conductor track previously applied to the auxiliary layer can be rolled up in the process and an electrical coil can be produced in this way.

The major advantage over the methods for producing electrical coils as known in the prior art is that the winding operation can be carried out not for instance by complicated multiple deposition of different coil turns but rather as it were automatically by bending back the auxiliary layer and, at the same time, the conductor track applied thereon. The bending-back occurs after the removal of the auxiliary layer from the substrate in the manner which has already been described and is known per se. As further and further layer sections of the auxiliary layer are removed more extensively from the substrate, these, too, are bent back and layer sections that have already been removed are moved further. Finally, the situation results in which the edge of the auxiliary layer that was removed first is bent back on itself.

As has been shown in the second-mentioned publication, what can be achieved is that the front edge of the auxiliary layer, which was removed first, is pushed into the hollow cylinder, so that, as a result, not just one winding can be completed but rather, by continuing to remove the auxiliary layer from the substrate, the rolling-up can be continued correspondingly and it is thus possible to produce a plurality of windings. The coil diameter may in turn be determined by the choice of layer thickness of the auxiliary layer, which, if appropriate, may be formed by a multiple layer system. It is thus possible optionally to produce so-called nanocoils having diameters of a few nanometers or microcoils having diameters of a few micrometers.

The removal of the auxiliary layer from the substrate may be effected, as known per se and already described, in that, before the deposition of the auxiliary layer, a sacrificial layer is deposited onto the substrate and the sacrificial layer is removed selectively, for instance by means of a selective etching operation.

The auxiliary layer may, on the one hand, be formed by a two-layer or multilayer system in the manner that is known per se, in the case of which system an internal strain is brought about in that the lattice constant of the bottommost layer is largest and becomes ever smaller with each further deposited layer. However, it may also be provided that the auxiliary layer is not a defined multilayer system, but rather an auxiliary layer constructed homogeneously from one material.

It is desirable and advantageous if the folding-over or rolling-up process ends automatically after a specific time on account of the constitution of the auxiliary layer, i.e. its material composition and/or thickness, so that a specific section of the auxiliary layer is removed from the substrate. The rolling-up process always commences at a so-called start edge. Consequently, a stop edge also always exists, at which the rolling-up process ends automatically and which can be defined beforehand by the arrangement. In this way, the rolling-up process need not necessarily be stopped by ending the selective etching in method step d.

The auxiliary layer to be removed preferably has, in plan view, a rectangular form in the case of which one of the side edges is defined as the start edge, and the edge opposite it is defined as the stop edge. The removal operation thus begins at the start edge by virtue of the underlying material of the sacrificial layer being selectively etched away. The etching operation may be effected isotropically, that is to say for instance by wet etching, since an etching that acts on a straight edge always leads to a uniform etching removal.

On an auxiliary layer formed in this way, a conductor track is to be applied by sputtering or the like in such a way that it extends on at least one section, preferably the entire length of the auxiliary layer from the start edge as far as the stop edge, in such a way that it has everywhere a component in the direction of the rolling movement of the auxiliary layer. In the simplest case, it extends at a predetermined distance from the side edge parallel to the direction of the rolling movement and thus forms turns which are located within one plane. However, this may be disadvantageous particularly when the intention is to produce multiple turns which are located one above the other in this case. Since the auxiliary layer lying between the adjacent conductor track turns may, if appropriate, be very thin and lightly doped, this may result in short circuits or breakdowns between adjacent turns of the completed coil. In this case, it is more advantageous if the conductor track is already applied to the auxiliary layer at an angle to the direction of the rolling movement. During rolling-up, the conductor track is in this case wound helically, so that successive turns do not lie in one plane and short circuits and the like cannot occur.

The conductor track may begin at a point at the start edge of the auxiliary layer and extend in a straight line from there at a specific angle as far as the stop edge of the auxiliary layer. The angle between the direction of the conductor track and the direction of the rolling movement, which is generally oriented perpendicular to the start or stop edge, can be coordinated with the expected diameter of the nanotube.

After its production, the coil has to be electrically contact-connected. In order to facilitate this, suitable measures may already be taken during the preparation of the corresponding layers. By way of example, the conductor track may be applied to the auxiliary layer such that a contact section at the end is produced beyond the stop edge, which contact section is not concomitantly rolled up during the later rolling-up operation. One end of the coil can thus easily be electrically contact-connected by means of conventional bonding or the like. The other end of the conductor track generally lies in the interior of the coil after the rolling-up operation and is thus not as readily accessible. The electrical contact-connection may be effected for example in that a drop of conductive material is passed onto an end face of the nanotube, which is drawn into the nanotube by the capillary action thereof and thus produces the electrical contact toward the outside. This may additionally be facilitated by virtue of a contact conductor track which runs along the start edge being produced at the start edge at which the conductor track begins. After the rolling-up operation, the contact conductor track is thus led as far as both end faces of the nanotube and an electrical contact between the contact conductor track and an external connection can readily be produced by means of liquid conductive material.

The contact conductor track may simultaneously serve as ferromagnetic coil filling. If desired, however, the entire interior of the coil may additionally or instead be filled with a ferromagnetic and electrically conductive material.

The method according to the invention may be extended to the effect that two coils oriented parallel are produced, which form a transformer for voltage conversion. The power of this transformer can be increased by the magnetic coupling by means of a ferromagnetic material. In this case, an electrical insulation of said magnetic coupling is necessary, under certain circumstances, since they simultaneously form the respective electrical contacts of the coils.

During the production process, the coils may be rolled both from the inside outward, i.e. toward one another, and from the outside inward, i.e. away from one another.

The second aspect of the invention relates to a method for producing a microcapacitor in which likewise, in accordance with the basic concept of the present invention, a section of an auxiliary layer is removed from a substrate and a first conductor layer previously applied to the auxiliary layer is concomitantly taken in the process. Said first conductor layer is to be positioned relative to a second conductor layer in such a way that both conductor layers form capacitor electrodes.

The following two fundamental possibilities exist for this, which differ in the fact that the second conductor layer is applied to the auxiliary layer before or after the removal operation.

In a first variant, the second conductor layer, like the first conductor layer, is applied to the auxiliary layer before the removal operation. It is possible to produce a plate capacitor, for example, by virtue of the first and second conductor layers being positioned relative to one another during the removal operation in such a way that they are situated opposite each other as plates of a plate capacitor.

In this case, it may be provided that the second conductor layer is not situated on that section of the auxiliary layer which is to be removed, and, consequently, is not concomitantly taken with the auxiliary layer that is removed during the removal operation. The second conductor layer thus remains stationary during the removal operation. This may be the case for example if Method I is carried out for the removal operation. The first and second conductor layers are arranged in a manner spaced apart from one another on the auxiliary layer in such a way that, after completed folding-over of the auxiliary layer during the removal operation, the first conductor layer is situated essentially above the second stationary conductor layer. The removal operation can thus be stopped as soon as the folding-over is completed. However, it is also possible to perform Method II with a stationary second conductor layer.

For the production of a plate capacitor according to the first variant, however, it may equally be provided that the second conductor layer, like the first conductor layer, is situated on that section of the auxiliary layer which is to be removed, and, consequently, is concomitantly taken with the auxiliary layer that is removed during the removal operation. This process can be performed by Method I or Method II.

In the first variant, a cylindrical capacitor may also be produced by virtue of the fact that a first conductor layer is applied at one end of the auxiliary layer and a second conductor layer is applied at the other end of the auxiliary layer as seen in the rolling direction. The first conductor layer is then rolled up into the interior of the cylinder and wrapped with a plurality of windings of the auxiliary layer. The rolling operation is continued until the second conductor layer is reached and has likewise been rolled up around the cylinder. The outer conductor layer is connected to a contact section which can be electrically contact-connected by conventional bonding, while the inner conductor layer can be contact-connected by the capillary process already described in connection with coil production. The dielectric of the capacitor produced is formed by the turns of the auxiliary layer.

In a second variant, a cylindrical capacitor is formed by virtue of the fact that, before the removal process, only the first conductor layer is applied to the auxiliary layer and is then rolled up by Method II and wrapped with a plurality of turns of the auxiliary layer. Afterward, the second conductor layer is applied to the outer lateral area of the rolled-up auxiliary layer.

The second aspect of the invention provides a microcoil having a cylindrical body, which is formed in that an auxiliary layer with a conductor track deposited on it is rolled up spirally in one or more turns.

As already explained in connection with the method according to the invention, the auxiliary layer may be constructed from a plurality of layers, in particular from two layers, which have lattice constants that decrease from the inside outward. However, the auxiliary layer may also be a single, inherently homogeneous material layer.

As has likewise been described in connection with the method according to the invention, the conductor track may be wound up within the microcoil to form a spiral lying in one plane or to form a helical spiral. The latter embodiment reduces the risk of short circuits or breakdowns between adjacent coil turns.

In the interior of the coil, the auxiliary layer has an end edge which corresponds to the start edge defined with respect to the method according to the invention. The conductor track preferably begins at said end edge and then runs spirally in the manner described together with the auxiliary layer on which it is applied. It may additionally be provided that the conductor track is connected at the end edge to a contact conductor track which is led parallel to the end edge to one or both coil ends in order to be connected there to an external electrical contact.

In addition to said contact conductor track, the interior of the coil may also be filled with a ferromagnetic material for reasons of increasing the magnetic flux.

The third aspect of the invention provides a microcapacitor having an essentially cylindrical body, which is formed in that an auxiliary layer with two conductor layers deposited thereon is rolled up spirally in one or more turns in such a way that the conductor layers are formed as capacitor electrodes.

As already explained in a different context, the auxiliary layer may be constructed from a plurality of layers, in particular two layers, which have lattice constants that decrease from the inside outward. However, the auxiliary layer may also be a single, inherently homogeneous material layer.

The microcapacitor may be formed in particular as a plate capacitor by virtue of the fact that the auxiliary layer is folded over at one end and the conductor layers applied on the auxiliary layer are arranged such that they essentially lie opposite in the interior of the folded-over section.

The microcapacitor may also be formed as a cylindrical capacitor by virtue of the fact that the auxiliary layer is rolled up in a plurality of turns and a first conductor layer is applied on its inner end and its outer end is connected to a second conductor layer.

BRIEF DESCTIPTION OF THE DRAWINGS.

The invention is explained in more detail below using exemplary embodiments in conjunction with the drawings, in which:

FIGS. 1*a-c* show the individual stages during the removal and rolling-up of a strained layer from a substrate;

Figure 4A:
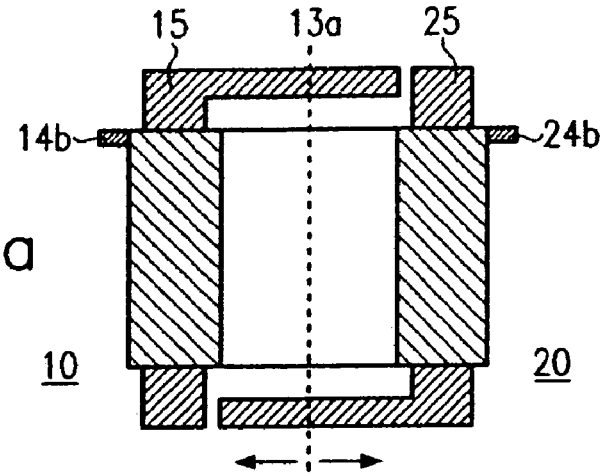
Figure 4B:
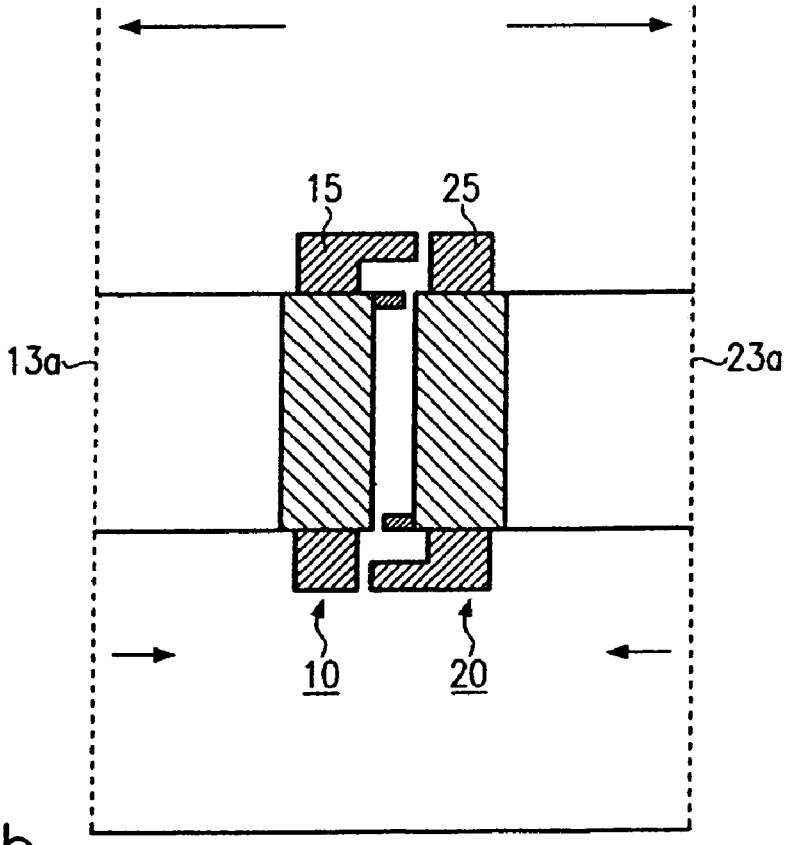
Figure 5A:
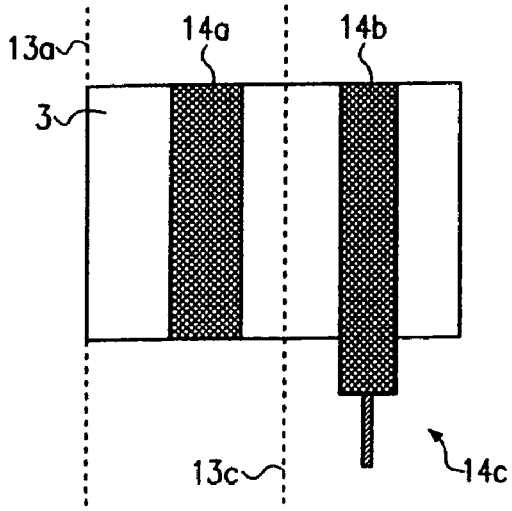
Figure 5B:
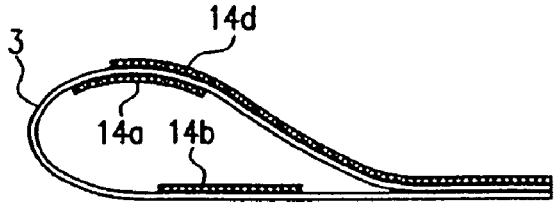

FIG. 4*a* shows a first embodiment for performing the production of a microtransformer according to the invention;

FIG. 4*b* shows a second embodiment for performing the production of a microtransformer according to the invention;

FIG. 5*a* shows an auxiliary layer with applied conductor layers for the production of a microcapacitor (plate capacitor) according to Method I;

FIG. 5*b* shows a side view of the microcapacitor completed in accordance with FIG. 5*a;*

Figure 6A:
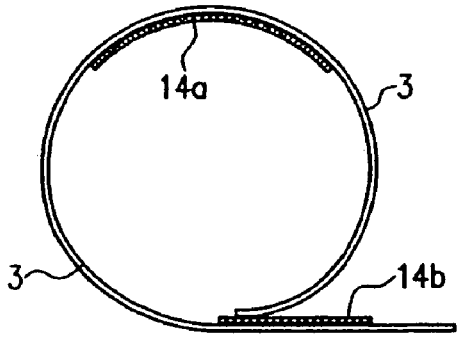
Figure 7A:
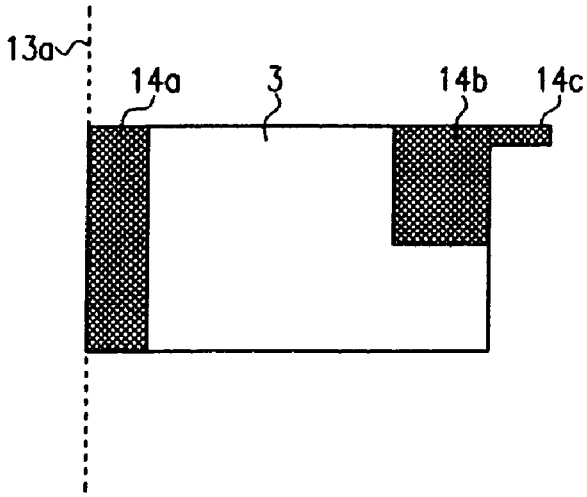
Figure 7B:
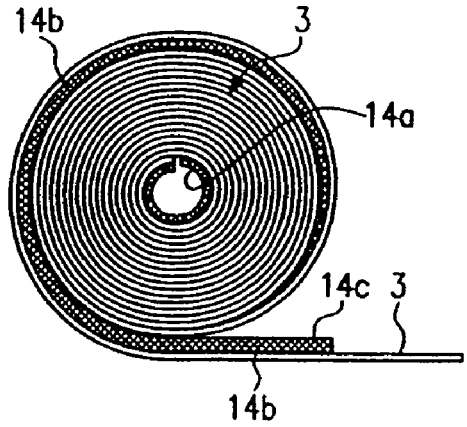

FIGS. 6*a, b* show side views of microcapacitors produced according to Method II;

FIG. 7*a* shows an auxiliary layer with applied conductor layers for the production of a microcapacitor (cylindrical capacitor) according to Method II;

FIG. 7*b* shows a side view of the microcapacitor completed in accordance with FIG. 5*a;*

Figure 8:
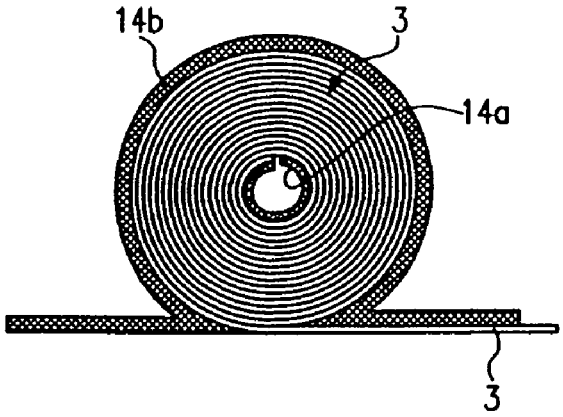

FIG. 8 shows a side view of a further microcapacitor produced according to Method II (cylindrical capacitor).

DETAILED DESCRIPTION OF THE INVENTION.

Figure 1C:
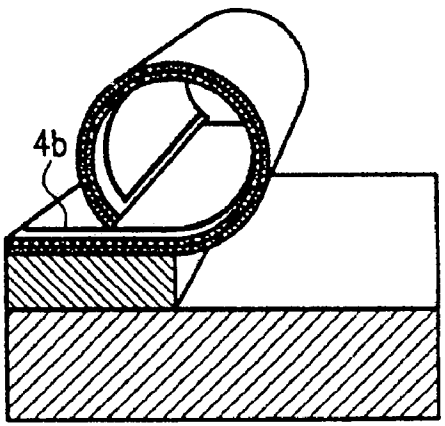
Figure 1B:
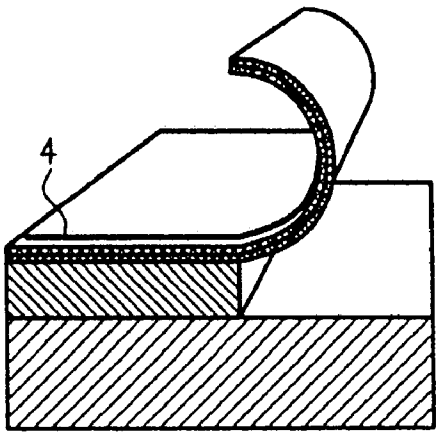
Figure 1A:
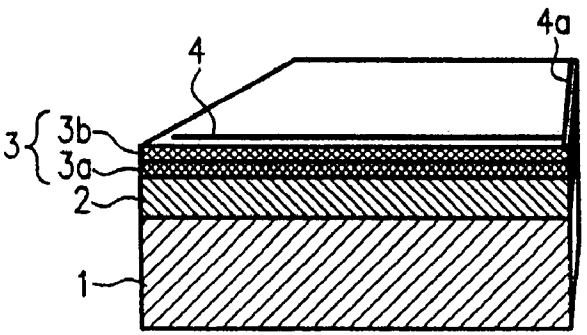

In accordance with FIG. 1*a,* firstly a Ge sacrificial layer 2 is applied on an Si substrate 1 according to Method II already explained in the introduction. A double layer 3 comprising a lower layer 3*a* and an upper layer 3*b* is then deposited onto said sacrificial layer, the lower layer 3*a* having a larger lattice constant than the upper layer 3*b*. The lower layer 3*a* may be an SiGe layer with a relative excess of Ge, while the upper layer 3*b* may be such an SiGe layer with a relative excess of Si.

A metallic conductor track 4 is applied on the upper layer 3*b* of the double layer 3, which conductor track may be produced for example from aluminum or copper and may be applied by means of a lithographic process and vapor deposition or sputtering. In this embodiment, the conductor track 4 extends parallel to the side edges of the double layer 3 and thus parallel to the direction of the rolling movement of the double layer 3 to be removed. A contact-connecting track 4*a* is additionally formed at the start edge of the double layer 3, said contact-connecting track being connected to the conductor track 4 and serving to produce an electrical contact with the inner end of the conductor track 4 after completion of the microcoil.

The selective etching of the Ge sacrificial layer has the effect that the double layer 3 is removed and, as described, bends in a manner directed away from the substrate 1 on account of its internal lattice mismatch and the resultant forces (FIG. 1*b*).

In FIG. 1*c*, the moment is reached at which the bent-back double layer 3 is bent back on itself and, on account of the removal of further layer sections, is pushed into the hollow cylinder which it itself has already formed. The double layer 3 is thus rolled up with the conductor track 4 applied on it. Continuation of the removal process leads to further rolling-up and thus to the production of further turns of the double layer 3 and the conductor track 4 in the hollow cylinder if the length of the deposited conductor track 4 suffices and/or the diameter of the microcoil is small enough. This last can be achieved through a choice of the layer thickness of the double layer 3 and through the severity of the lattice mismatch and thus the magnitude of the strain of the double layer 3.

The rolling-up is ended upon reaching an outer contact section 4*b* of the conductor track 4. Said outer contact section serves for later electrical contact-connection of the microcoil and is not rolled up.

Figure 2:
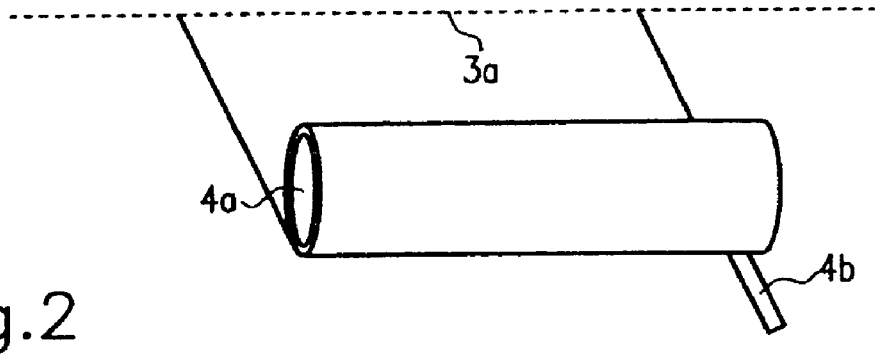
FIG. 2 shows a view of the completed coil.

FIG. 2 illustrates the completed microcoil again from a different perspective. The start edge 13*a* of the double layer 3 is illustrated in the background. One end of the contact conductor track 4*a* can be seen at the left-hand end of the microcoil, which end can be externally contact-connected by liquid conductor material. The contact section 4*b* can be seen at the bottom on the right, which contact section can be contact-connected by conventional bonding.

Figure 3:
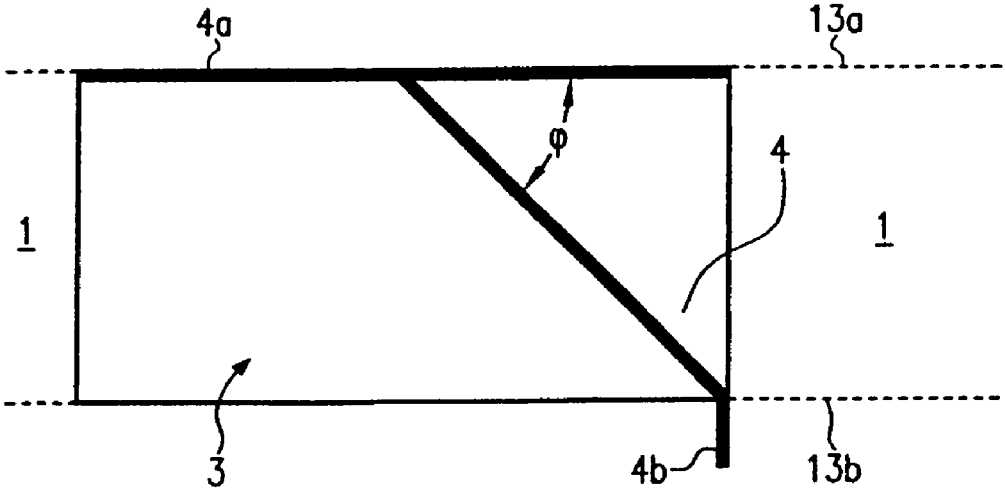
FIG. 3 shows a plan view of an embodiment of a strained layer and a conductor track deposited thereon prior to removal.

A further embodiment of performing the production of a microcoil is described with reference to FIG. 3. FIG. 3 illustrates a plan view of a strained layer 3 which is deposited on a substrate 1 and is to be rolled up. The layer 3 is applied to the substrate 1 in the form of a rectangle and has a start edge 13*a* and a stop edge 13*b*. The conductor track 4 is deposited on the layer 3 and is connected to a contact conductor track 4*a* running at the start edge 3*a*. In this embodiment, the conductor track 4 extends at an angle $\phi$ rather than perpendicularly to the start edge 3*a*.

Finally, FIGS. 4*a, b* also illustrate two different embodiments of microtransformers produced according to the invention. These microtransformers in each case comprise two oppositely situated microcoils which are rolled up in two simultaneous or successive rolling processes by the method according to the invention.

In accordance with FIG. 4*a*, proceeding from a common start edge 13*a*, two coils 10, 20 are produced by two rolling processes in which the rolling-up of the coils is directed away from one another. Afterward, the coils 10, 20 are in each case filled with a ferromagnetic material 15, 25. In contrast to conventional transformers, the ferromagnetic core cannot be formed in continuous fashion since, in the present case, it simultaneously represents the inner electrical contact of the coils 10, 20 or is electrically connected at least to the inner ends of the coils 10, 20. If it is not possible for the coil cores of the two coils, said coil cores being formed by the ferromagnetic materials, to be electrically insulated from the respective conductor tracks, then the ferromagnetic materials 15, 25 of the coils 10, 20 must therefore be electrically insulated from one another. This is illustrated in FIGS. 4*a, b* by gaps between the ferromagnetic materials 15 and 25.

In accordance with FIG. 4*b*, the microtransformer is produced by rolling the coils 10, 20 toward one another proceeding from respectively separate start edges 13*a*, 23*a*.

As an alternative to the material system mentioned with regard to the exemplary embodiments described, it is also possible to use a GaAs-based material system. In this case, the substrate may be formed by GaAs. The sacrificial layer may be produced from AlAs. The strained layer may be a double layer in which the two individual layers are in each case formed by InGaAs, the lower layer having a relative excess of the composite component InAs and the upper layer having a relative excess of the composite component GaAs. As a result, it is ensured in this exemplary embodiment, too, that the lower layer has a higher lattice constant than the upper layer.

In accordance with FIGS. 5*a, b*, a microcapacitor is produced according to Method I already explained in the introduction. FIG. 5*a* first of all shows a plan view of the auxiliary layer 3 applied on a substrate and a sacrificial layer. Conductor layers 14*a* and 14*b*, which are intended to form the later capacitor electrodes, are applied to said auxiliary layer 3. The start edge 13*a* is situated at the left-hand edge of the auxiliary layer 3 in FIG. 5*a*. The arrangement of the conductor layers, in particular the distance between them and the distance between the conductor layer 14*a* and the start edge 13*a*, is such that only the conductor layer 14*a* is concomitantly taken by the auxiliary layer 3 being removed, but not the conductor layer 14*b*. The bend edge 13*c* is situated between the two conductor layers.

The removal operation is continued until the auxiliary layer 3 has folded over, as is illustrated in FIG. 5*b*. In this end state, the conductor layers 14*a* and 14*b* are arranged such that they lie opposite, and may thus represent the electrodes of a plate capacitor.

The microcapacitor produced in this way may be contact-connected such that the stationary conductor layer 14*b* is provided with contact sections 14*c* which are applied as early as before the folding-over process in a work step together with the conductor layer 14*b*, as is illustrated in FIG. 5*a*. Said contact sections 14*b* are preferably situated outside the auxiliary layer 3 and can be electrically contact-connected by conventional bonding. By contrast, the other conductor layer 14*b* may be electrically contact-connected by a contact-connecting layer 14*d* which is applied to the folded-over auxiliary layer 3 and, with the conductor layer 14*b*, forms an electrical tunnel contact through the extremely thin auxiliary layer 3.

The microcapacitor may be filled with a dielectric before or after the electrical contact-connection and be closed off by pressing onto the capacitor ends. The layers pressed onto one another then bond together automatically.

Figure 6B:
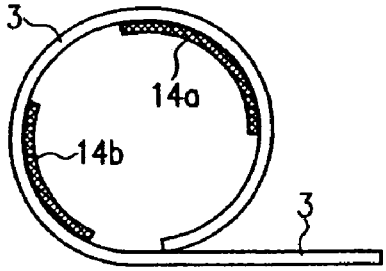

FIGS. 6*a, b* illustrate two completed microcapacitors in a side view and cross-sectional view, respectively, said microcapacitors having been produced by Method II. The thickness of the auxiliary layer 3, formed by a double layer in this case, and the relative arrangement of the conductor layers are chosen differently in the two cases such that, in the case of FIG. 6*a,* the conductor layer 14*b* remains stationary during the production process, while, in the case of FIG. 6*b,* it is concomitantly taken, like the conductor layer 14*a,* with the auxiliary layer 3 being rolled up. Here, too, the electrical contact-connection may be provided by externally applied metallic contact-connecting layers in the case of the conductor layers situated on a peripheral section of the rolled-up auxiliary layer 3.

In accordance with FIGS. 7*a, b,* a microcapacitor is produced in the form of a cylindrical capacitor according to Method II. FIG. 7*a* first of all shows a plan view of the auxiliary layer 3 applied on a substrate and a sacrificial layer. Conductor layers 14*a* and 14*b,* which are intended to form the later capacitor electrodes, are applied to said auxiliary layer 3. The start edge 13*a* is situated at the left-hand edge of the auxiliary layer 3 in FIG. 7*a*. The rolling-up operation begins at the conductor layer 14*a* and the latter is rolled up and wrapped by a plurality of plies of the auxiliary layer 3 until finally the conductor layer 14*b* is reached, which is likewise rolled up except for an external contact section 14*c*. The cylindrical capacitor is thus formed between the conductor layer 14*b* lying on an outer cylindrical area and the conductor layer 14*a* lying on an inner cylindrical area and the dielectric is formed by rolled-up material of the auxiliary layer 3.

The electrical contact-connection of the inner conductor layer 14*a* may be brought about by the capillary method already described in connection with the production of microcoils, while the outer conductor layer 14*b* may be contact-connected at its contact-connecting section by conventional bonding.

Finally, FIG. 8 also illustrates a further cylindrical capacitor produced by the method according to the invention. This cylindrical capacitor is produced in that initially only one conductor layer 14*a* is applied to the auxiliary layer near a start edge and this conductor layer is rolled-up by Method II and wrapped by a plurality of plies of the auxiliary layer. Said conductor layer forms the inner electrode of the cylindrical capacitor to be produced and, as already mentioned, may be electrically contact-connected by the capillary method. After the rolling-up operation, an outer conductor layer 14*b* is then applied to the rolled-up auxiliary layer 3 for example by vapor deposition or sputtering, which layer forms the second capacitor electrode and may be electrically contact-connected by conventional bonding.

With regard to the construction of the auxiliary layer, the sacrificial layer and the substrate and other features relating to the folding-over or rolling-up process, the same explanations and features as for the microcoils dealt with further above apply to microcapacitors.

The invention claimed is:

1. A method for producing a microcoil, comprising:

providing a substrate;

applying a non-metallic auxiliary layer over the substrate, the auxiliary layer having an intrinsic stress profile vertical to a plane of the auxiliary layer;

applying a conductor track onto the auxiliary layer; and releasing a portion of the auxiliary layer from the substrate, thereby causing a rolling of the released portion of the auxiliary layer and the conductor track due to the intrinsic stress profile of the auxiliary layer, wherein the conductor track is applied to the auxiliary layer such that, prior to the rolling, at least a portion of the conductor track extends at a non-zero angle to the direction of the rolling, and the portion of the conductor track has a constant width in a direction parallel to the plane of the auxiliary layer.

2. The method as claimed in claim 1, wherein the auxiliary layer is released from the substrate by selective removal of a sacrificial layer situated between the auxiliary layer and the substrate.

3. The method as claimed in claim 1, further comprising:

applying a sacrificial layer to the substrate prior to applying the auxiliary layer to the substrate and applying the auxiliary layer to the sacrificial layer; and releasing a portion of the auxiliary layer from the substrate by selectively removing the sacrificial layer.

4. The method as claimed in claim 3, wherein the auxiliary layer is applied in the form of a plurality of layers, including at least two layers each having a lattice constant, to the sacrificial layer, and the lattice constant of each layer decreases in order of deposition.

5. The method as claimed in claim 3, wherein a single homogeneous auxiliary layer is applied to the sacrificial layer.

6. The method as claimed in claim 3, wherein the auxiliary layer is applied to the sacrificial layer in such a way that the auxiliary layer has a start edge and an opposite stop edge, the selective removing of the sacrificial layer commences at a section of the sacrificial layer which lies below the start edge of the auxiliary layer, and the rolling ends at the stop edge on account of the constitution of the auxiliary layer, including the material composition, thickness, and/or distance between start edge and stop edge of the auxiliary layer.

7. The method as claimed in claim 6, wherein the conductor track is applied to the auxiliary layer such that the conductor track extends essentially as far as a side edge of the auxiliary layer, in particular as far as a side edge of the auxiliary layer that connects the start and stop edges to one another.

8. The method as claimed in claim 3, wherein the conductor track is applied to the auxiliary layer such that the conductor track extends on at least one section parallel to the direction of the rolling.

9. The method as claimed in claim 3, wherein the conductor track is rolled up apart from a contact section at the end of the conductor track on account of the selective removing of the sacrificial layer.

10. The method as claimed in claim 9, wherein the microcoil is electrically contact-connected such that an electrical contact is produced between an inner end of the rolled-up conductor track and an outer contact by introduction of a conductive, in particular liquid, material, and the contact section at the end of the conductor track is contact-connected.

11. The method as claimed in claim 1, further comprising:

inserting a ferromagnetic material into the interior of the microcoil or concomitantly rolling the ferromagnetic material up with the microcoil.

* * * * *